United States Patent [19]

Williams et al.

[11] 4,408,405

[45] Oct. 11, 1983

[54] UNDERWATER EXCAVATOR

[75] Inventors: Harry S. Williams, West Jefferson; Jan B. Yates, Reynoldsburg; John J. Reidy, Orient, all of Ohio; Ernest Faccini, Marbury, Md.; Terry E. Hill, Thornville; William K. Shafley, Columbus, both of Ohio

[73] Assignee: The United States of America as represented by the Secretary of the Navy, Washington, D.C.

[21] Appl. No.: 250,471

[22] Filed: Apr. 2, 1981

[51] Int. Cl.[3] ..... E02F 5/00

[52] U.S. Cl. ..... 37/62; 405/11

[58] Field of Search ..... 37/61–63, 37/78, 54, 56; 405/11–14, 248, 267, 74, 8; 114/55; 294/66 R

[56] References Cited

U.S. PATENT DOCUMENTS

| | | | |
|---|---|---|---|
| 294,078 | 2/1884 | Robinson | 405/11 |
| 371,561 | 10/1887 | Elliott | 405/248 X |
| 782,383 | 2/1905 | Doty | 405/14 |
| 807,456 | 12/1905 | Gilbert | 405/248 X |
| 1,520,945 | 12/1924 | Griesemer | 37/62 |
| 1,529,084 | 3/1925 | Peters | 405/248 |
| 1,690,239 | 11/1928 | Nicol | 37/61 |
| 1,905,643 | 4/1933 | Johnson | 405/13 |
| 1,967,490 | 7/1934 | White | 405/14 |
| 2,931,187 | 4/1960 | Perkins | 405/13 |
| 4,015,873 | 4/1977 | Langguth | 294/66 R |
| 4,026,593 | 5/1977 | Brown et al. | 294/66 R |
| 4,189,253 | 2/1980 | Pekor | 37/61 X |

*Primary Examiner*—Clifford D. Crowder

*Attorney, Agent, or Firm*—R. S. Sciascia; A. L. Branning; J. C. LaPrade

[57] ABSTRACT

An underwater excavator comprising a modular non-metallic cofferdam wherein water under pressure exits from a plurality of nozzles along at least one side of the base of the cofferdam and a fluid driven eductor driven by pressurized fluid evacuates the suspended solids raised by the pressurized fluid that flows through the nozzles, with a plurality of small barrier nozzles located along one or more horizontal conduits used to sink the cofferdam.

12 Claims, 9 Drawing Figures

UNDERWATER EXCAVATOR

BACKGROUND OF THE INVENTION

The invention relates to an excavator for underwater ordnance. It is established that inspection of underwater ordnance is very difficult, time consuming and dangerous. Ordnance inspection and disarming is even more complicated and involved when the ordnance is fully or partly buried either intentionally or due to the natural forces of the sea. In order to inspect buried or covered ordnance it must first be uncovered.

The very nature of the ordnance may make excavation extremely hazardous. The ordnance may be both magnetically and acoustically influenced, and possibly impact and attitude sensitive. Ideally, the excavation procedure should be accomplished either automatically or by remote control to minimize the risk to the divers. Such unmanned operation is complicated by the various possible shapes of the objects, which may include artillery projectiles, mines, and torpedoes. It is further complicated by the natural tendency of typical sea floor materials to flow back into the excavation site. To avoid the need to excavate a large, shallow hole, an external barrier or cofferdam is required. This reduces the amount of material to be excavated by increasing the effective angle of repose of the sides of the hole.

The various shapes of the covered ordnance that may be encountered necessitates the use of excavation equipment and techniques which will effectively uncover a variety of rectilinear shapes, including rectangular or other unusual shapes. Because of these factors the excavating system should have means for circumscribing the region that is to be cleared or uncovered.

Therefore, the field of the invention is an underwater excavator with means for circumscribing buried-underwater ordnance.

DESCRIPTION OF THE PRIOR ART

In the past, most underwater excavation equipment and methods have required either a diver at the excavation side or massive surface support.

The prior art methods of excavating can be divided into two categories. One category is pure mechanical excavation while the other category is some form of fluid means of excavation. The fluid means may utilize air or water under pressure, usually utilized with jet nozzles, hoses, eductors and air lift equipment.

The mechanical excavators are limited to shallow water, usually less than 50 ft. in depth. These mechanical underwater excavators require massive surface support. They are constructed of massive metal components that cannot be used around live ordnance because metallic excavators activate magnetic or acoustical sensors in such ordnance. Mechanical excavators of this type ordinarily have very large power plants to operate the machinery. This type of prior art excavators, made of metallic materials are slow, cumbersome devices that readily activate magnetic and acoustic sensors. The associated surface support vessel is also of such size and construction as to activate magnetic and acoustic sensors.

The prior art mechanical excavators, made of metallic materials, are controlled from a surface vessel and uncover the bottom surface near one side of the surface vessel.

In the fluid means excavators used in the prior art, a liquid or gas has been used as the driving means.

The underwater excavators using gas as the working fluid require large gas or air compressors on surface located ships or vessels. The method of operation in these excavators is to pump large volumes of air through hoses to physically lift the soil by means of air bubbles. This system produces substantial acoustic waves (noise). Such a system is difficult to control from a surface craft or by divers in the water.

The underwater excavators that use water or other liquids under pressure as the working fluid use jets and eductor systems. The devices that use water as the working fluid operate by pumping pressurized water through nozzles and directing the resulting jet of water at the area to be excavated. Some of these excavators require a diver to aim the jet during excavation in order to penetrate deeper into the excavation area. Further, the efficiency of these devices improves at higher pressures. However, when the pressure is higher, and the efficiency is higher, the noise level is also higher. In many of the prior art devices, the high pressure nozzles are usually fabricated metal.

A prior art eductor consists of high pressure tube and nozzle within an open ended cylinder. Water is pumped through a high pressure tube and nozzle and jetted into one end of the cylinder. This causes a low pressure region at one end of the cylinder, thereby sucking water and debris in through that end of the cylinder and ejecting it out through the opposite end. An eductor system is only usable with fluidized materials because of the low vacuum power of the system. Further, many of the prior art devices are made of metal and require diver attendance during all phases of the excavation operations.

OBJECTS OF THE INVENTION

It is one object of this invention to provide a new and improved underwater excavation device made entirely of non-metallic materials.

It is also an object of this invention to provide an underwater excavator that can be remotely operated.

It is another object of the invention to provide an underwater excavator that has minimum power requirements.

It is also an object of the invention to provide an underwater excavator that is acoustically quiet and creates a low level of acoustic waves.

It is also an additional object of the invention to provide an underwater excavator deployable by two men.

It is another object of the invention to provide a lightweight portable underwater excavator that automatically shores up around an opening as it buries itself in the floor of the body of water, i.e., ocean, bay, or river.

It is also one additional object of the invention to provide a non-metallic totally non-magnetic underwater excavator that is capable of self burying while it shores up around the walls of the opening.

SUMMARY OF THE INVENTION

The excavator is a completely plastic cofferdam with a built in eductor-type pump and stirring nozzles. It will automatically bury itself around a sunken ordnance device by means of water jets on the bottom of the cofferdam. It will then automatically remove all the bottom material surrounding the ordnance by means of the eductor and the stirring nozzles. Each of these operations will occur without a diver in the water, thereby reducing the danger inherent in ordnance disposal. At the end of these operations an ordnance expert can disarm the explosive because it is free of the surrounding bottom material.

DETAILED DESCRIPTION OF THE PREFERRED EMBODIMENTS

The modular underwater excavator of the invention comprises a plurality of at least four (4) adjacent barrier wall elements arranged and clamped in a rectangular modular arrangement. Each wall is made up of a square or rectangular framework of hollow plastic pipe, usually polyvinyl chloride pipe that may be from 2 to 3 inches in diameter. The framework is covered with a thin plastic covering or other non-metallic sheeting, for example a polyethylene or vinyl coated nylon fabric sheeting material. In at least one barrier wall (known as the main jet barrier) of the module pressurized water is pumped through the tubular framework to exit through a number of nozzles (typically 3) along at least one horizontal base (hollow pipe) member of one barrier wall of the module. In another wall of the module, usually opposite the barrier wall along which the multiple nozzles are positioned, a jet pump eductor mechanism is located. The eductor, through pressurized suction techniques that are well known, removes fluidized sand, dirt, debris, shells and other solids that are raised by the pressurized water pumped through the nozzles at the base of one barrier wall.

The four or more barrier walls are clamped together by suitable corner clamps.

Figure 1:
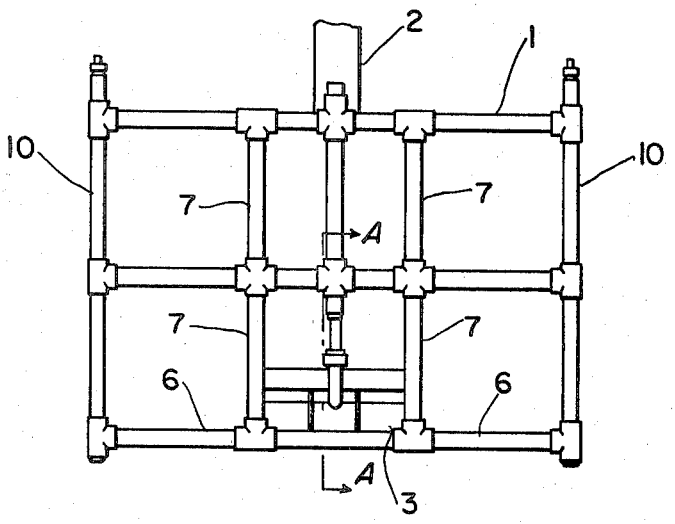
FIG. 1 is a side view of the eductor barrier of the invention.
Figure 2:
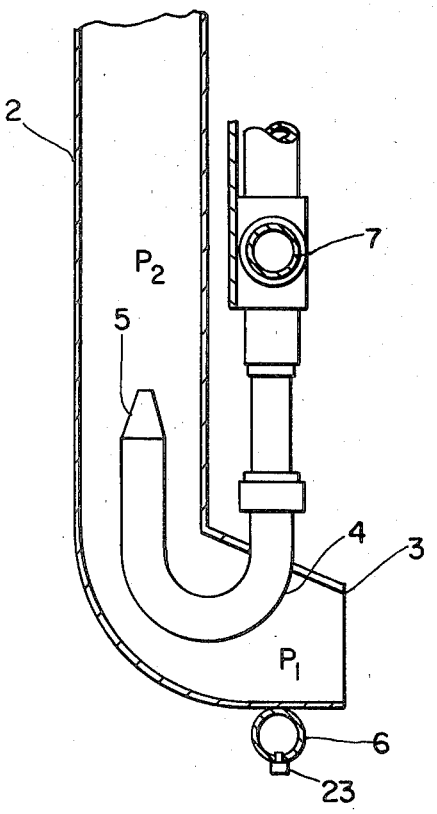
FIG. 2 is a section taken along line A—A of FIG. 1.

In FIG. 1 a barrier wall with eductor and a plastic covering is disclosed. The barrier framework 1 is made of polyvinyl chloride pipe. The eductor outlet pipe 2 is a cylindrical plastic pipe that is ten (10) inches in diameter. The jet pump eductor inlet baffle 3 is an opening in the plastic covering of the barrier wall, through which water with suspended solids such as sand, shells and other debris is pulled by the suction provided by the pressure differential in the exit conduit 2. Pressurized water pumped through pipes 10 powers the barrier jets located in the bottom of pipes 6. In FIG. 2 high pressure water is supplied through water supply line 4. The water is pumped to the eductor through the hollow pipe 7 that is part of the framework for the barrier wall. Suitable internal plugs in the pipe framework of each barrier are provided to separate the water flow required for powering the eductor, and the barrier jets, as these components are not always pressurized simultaneously or to the same pressure.

In the cross section shown in FIG. 2 a jet pump eductor is illustrated, where water under high pressure is pumped through conduit 7 and out through nozzle 5. This conduit 7 and nozzle 5 are made of plastic pipe, as is the entire system so that a bomb or mine that is being excavated is not detonated by magnetic forces. The increased velocity of the water and corresponding drop in pressure at $P_2$ as compared with pressure at point $P_1$ provides strong eduction action that sucks out the water suspended solids from within the walls of the excavator module.

Figure 3:
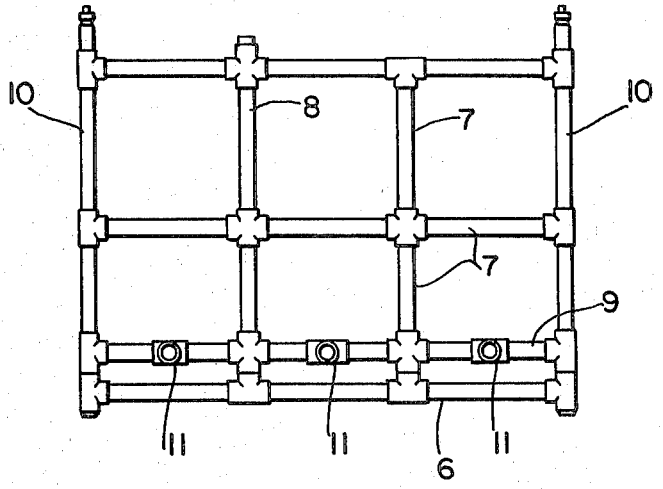
FIG. 3 is a side view of the main jet barrier.

The details of the main jet barrier wall are shown in FIG. 3. The vertical members 10 are barrier nozzle water supply lines. Conduit 8 is a main jet water supply line. In this embodiment three (3) nozzles 11 are located on the lower horizontal main jet distribution line 9. Again, internal plugs are used to separate the flow to the main jets from the flow to the barrier nozzles.

The nozzles 11 are ordinary pipe fittings that may be of smaller diameter than main jet supply line 9. They are non-metallic.

Figure 4:
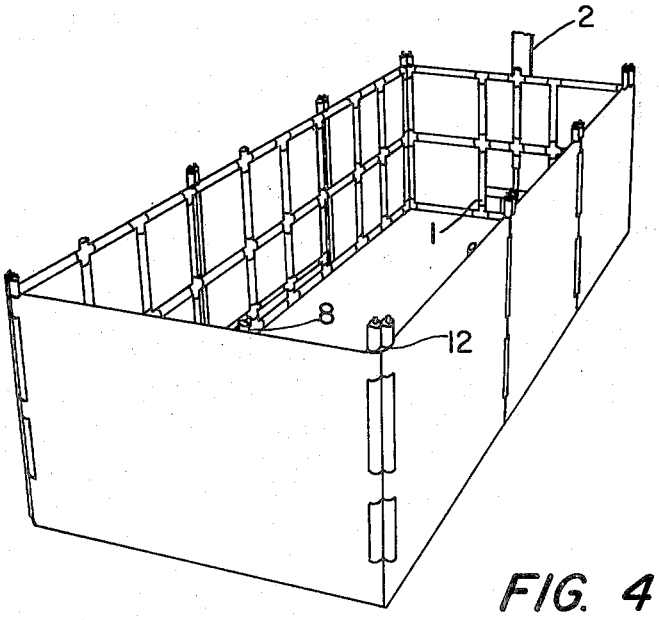
FIG. 4 is a perspective view of one assembled module including one eductor barrier, five main jet barriers and two plain barriers of this invention.

In FIG. 4, an underwater excavator is illustrated that has eight (8) barrier walls. This model is adapted for excavating torpedoes that are approximately 16 feet to 20 feet long. In this embodiment the eductor 2 is at one end of the excavator with a plain barrier on either side. The remaining barrier are main jet barriers with three (3) nozzles along a lower horizontal pipe as shown in FIG. 3. Other configurations with less side panels and/or no plain barriers are also possible.

A corner clamp 12 is used to clamp each of the vertical corner members.

Figure 5:
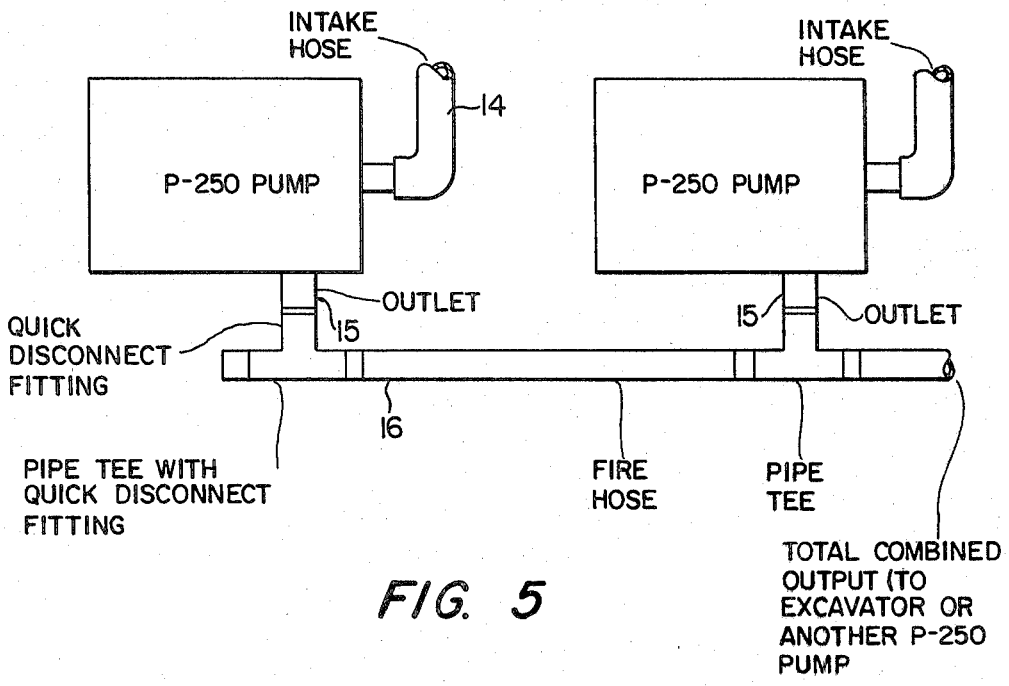
FIG. 5 is an assembly view of the power system arranged in parallel for the excavator module.

FIG. 5 illustrates one preferred arrangement for supplying pressurized fluid (water) to the underwater excavator. In this embodiment two standard Navy P-250 fire pumps 13 are connected in parallel for increased flow. Intake water, usually just ordinary sea water, is supplied to each of the intake hoses 14. The water is pressurized to the desired level, usually in the range of 20 psig to 100 psig and is then pumped through conduits 15 into a main supply line 16.

Figure 6:
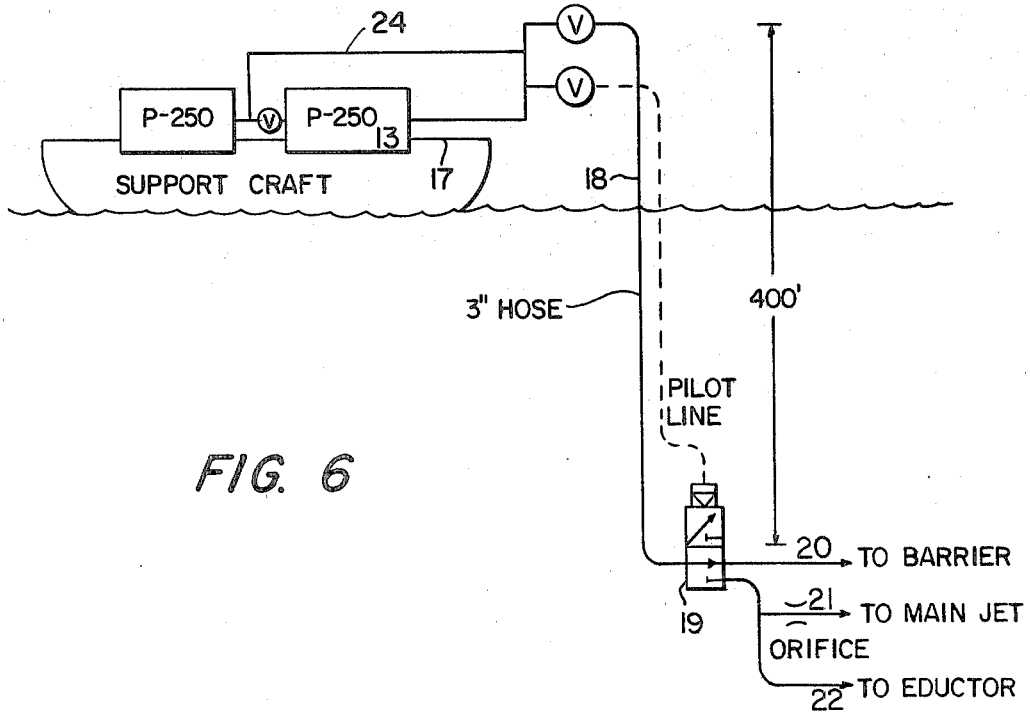
FIG. 6 is a schematic view of the pressure system that delivers pressurized water to multiple functions of the underwater excavator.

FIG. 6 is a schematic drawing of two pumps 13, hooked in parallel connection and both positioned on a support craft 17. The total cumulative output of these two pumps is communicated through a three (3) inch hose 18 to a remotely controlled valve 19. The valve is located near the barrier, in this particular illustration, at a depth of about four hundred feet. This location minimizes the length of the multiple hoses which are required to service the several excavator functions. The pressurized water is distributed to the barrier jets by conduit 20, to main jets through conduits 21, and to the eductor through conduit 22. The remotely controlled valve allows the barrier jets to be operated during emplacement and then turned off while the eductor and main jets are operating.

Figure 7:
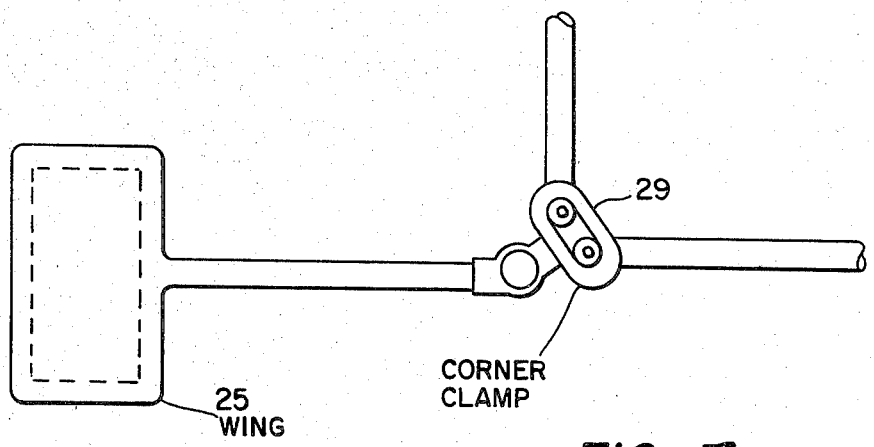
FIG. 7 is a top view of the corner clamp assembly of the invention.

FIG. 7, illustrates a typical corner clamp 29 that may be used to clamp two adjacent vertical posts 10 together in two adjacent, contiguous barrier walls. Other clamps that are mechanically equivalent may be used, particularly those that have a fast clamping and releasing action. Also illustrated is an adjustable depth wing 25 which controls the depth achieved during excavator burying.

In FIG. 7 a pair of corner clamps 29 fasten together two contiguous wall sections at 1 and 1*a*. The wing 25 is a depth regulator that maybe used to stabilize the excavator at a particular depth.

Figure 8:
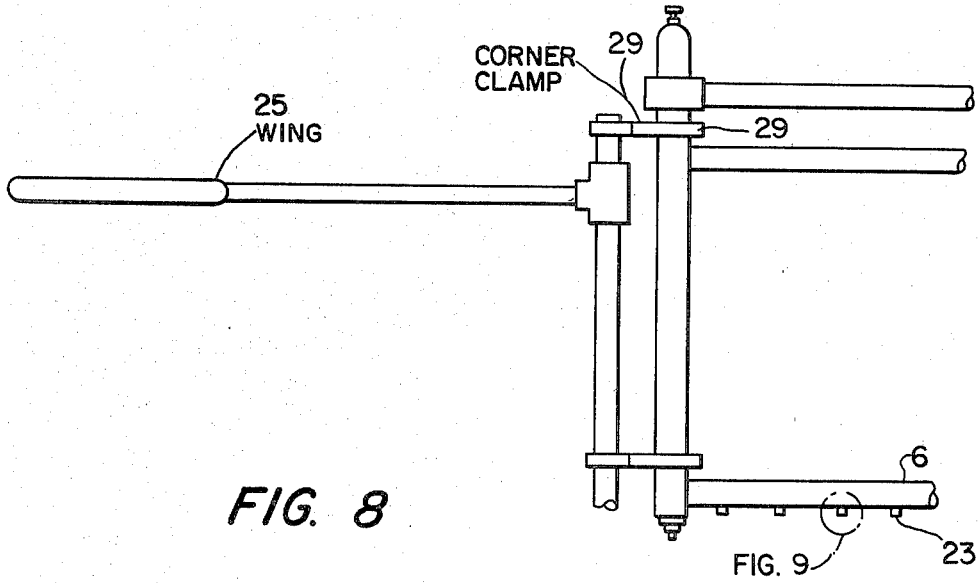
FIG. 8 is a plan view of the corner clamp of the invention.

In FIG. 8 horizontal element 6 is fitted with a number of small barrier nozzles 23, each containing three (3) water outlets. These outlets fluidize the bottom material to allow the barriers to sink to the desired level. Two openings in the nozzle point parallel to the bottom pipe 6 and one points perpendicularly down into the bottom. The parallel openings are slightly skewed away from the barrier to prevent erosion of the plastic material of the bottom pipe.

Figure 9:
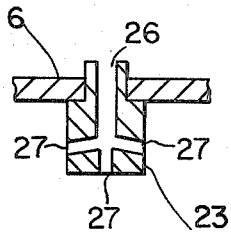
FIG. 9 is a detailed cross section of the barrier jet of the invention.

In FIG. 9 a detailed cross section of jet or barrier nozzle 23 is disclosed.

Suitable line 24 and valve V may be used to cause the pumps to be in parallel as shown in FIG. 6. These small nozzles 23 called barrier jets or barrier nozzles may be located on the bottom of any of the horizontal elements 6 to position the assembled modular excavator around the ordnance. These small nozzles 23 may be capped by the diver during the assembly and initial positioning of the excavator to prevent the opening from being clogged with sand or other debris. When the barrier jets are activated, the water in the bottom pipe 6 will build up sufficient pressure to force the caps off of the nozzles.

EXAMPLE

A four (4) barrier wall underwater excavator is assembled by corner clamps on the deck of a landing craft. Each wall has a six (6) foot length and four (4) foot width. The assembly has an open top and bottom, having an area of 36 square feet, is deployed by two divers. After deploying the assembled unit from the side of the landing craft, the divers guide the assembled underwater excavator and place it over a partly buried mine having dimensions of 2 ft. by 4 ft. After positioning the underwater excavator over the mine, one pressure hose is attached to the eductor, one hose to the main jet orifice and one hose to the barrier jets.

After the three (3) hoses 20, 21, 22 are attached to the module the diver returns to the landing craft and the pumps start to pump pressurized water to the barrier jets. After the barrier is deployed to the desired depth, flow to the barrier nozzles is turned off and the flow to the main jets and eductor initiated. These flows are continued until the ordnance has been uncovered sufficiently.

In one preferred embodiment a number of weights may be added to each barrier to help sink the excavator.

In FIG. 9 a cross section of the small barrier jet, has an opening 26 on the inside of a conduit 6 that communicates with several smaller exit conduits 27.

A number of jets 23 may be located in any desired spacing arrangement along any one of the horizontal conduits 6.

A number of internal plugs, valves or slide valves may be used to interrupt or cut off flow to the eductor or any other nozzle or function.

The mine is completely uncovered in 2 hours and all the four walls of the excavator have been buried to a depth of 2 feet.

In this example the side walls of the barrier wall are all cut from vinyl coated nylon fabric that is glued by PVC adhesive over the 2 inch cylindrical PVC pipe. In this example the three nozzles 20, 21, 22 are distributed at equal distances along the lower horizontal water distribution line.

It is to be understood that the foregoing disclosure relates to only a preferred embodiment of the invention and that various modifications may be resorted to by those skilled in the art without departing from the spirit and scope of the invention as hereinafter defined by the appended claims.

What is claimed as new and desired to be secured by Letters Patent of the United States is:

1. An underwater excavator for excavating a sensitive ordnance device comprising plural contiguous barrier wall members, wherein each of said members consists of a covered rectangular framework of hollow conduit with upper and lower horizontal members, where, each horizontal member comprises a part of the exterior barrier wall, with means to pump pressurized fluid through selected portions of the said horizontal members and where selected horizontal members are fitted with multiple nozzle means located along the underside of one or more said horizontal members, means to pump pressurized fluid through the said horizontal members and into the barrier nozzle means combined with a fluid driven jet pump eductor that produces differential pressure within the confines of the excavator, and means to pump pressurized fluid through the said eductor in order to remove suspended solids from the confines of the excavator so that the suspended solids are removed from the confines of the four barrier walls of the excavator by the differential pressure produced by pressurized fluid being pumped through said hollow conduit and into the jet pump eductor.

2. The underwater excavator of claim 1 wherein at least one additional upper horizontal member and one lower horizontal member is provided, each horizontal member having a plurality of nozzle means that are oriented in a horizontal plane.

3. The excavator of claim 1 wherein the four contiguous barrier walls are provided and joined together by corner clamps.

4. The excavator of claim 3 where plural nozzle means are provided along each of the lower horizontal members so that pressurized fluid pumped through the nozzle, causes to dig each wall member into the floor of the sea floor each wall section, supported by a horizontal member to be dug into the supporting floor.

5. The underwater excavator of claim 1 wherein upper and lower corner clamps are used to clamp the vertical corner members of four contiguous barrier wall members.

6. The underwater excavator of claim 5 wherein each barrier wall member is aligned at 90° to each adjacent barrier wall member.

7. The underwater excavator of claim 1 wherein all parts of the frame and thin wall covering are fabricated of non-metallic materials.

8. The underwater excavator of claim 7 wherein the underwater excavator is driven by fluid pressurized by a surface operated pump.

9. The underwater excavator of claim 1 wherein the eductor means comprises an opening in one of the barrier walls, an exit conduit in communication with said opening in the barrier wall and fluid pressure operated means to produce a pressure differential in the eductor.

10. The underwater excavator of claim 9 wherein the eductor comprises a nozzle that produces greater pressure at the mouth of the eductor than in the area of the jet nozzle.

11. The underwater excavator of claim 9 wherein the eductor is fabricated from polyvinyl chloride pipe and sheet.

12. The underwater excavator of claim 9 wherein pressure above the eductor nozzle is less than pressure below the eductor nozzle.

* * * * *